US006523995B2

(12) United States Patent
Fasano et al.

(10) Patent No.: US 6,523,995 B2
(45) Date of Patent: Feb. 25, 2003

(54) IN-TANK MIXING SYSTEM AND ASSOCIATED RADIAL IMPELLER

(75) Inventors: Julian B. Fasano, Englewood, OH (US); Mark Franklin Reeder, Tipp City, OH (US)

(73) Assignee: Chemineer, Inc., Dayton, OH (US)

( * ) Notice: Subject to any disclaimer, the term of this patent is extended or adjusted under 35 U.S.C. 154(b) by 0 days.

(21) Appl. No.: 09/816,580

(22) Filed: Mar. 23, 2001

(65) Prior Publication Data

US 2002/0136088 A1 Sep. 26, 2002

(51) Int. Cl.[7] ..... B01F 5/12
(52) U.S. Cl. ..... 366/264; 366/265
(58) Field of Search ..... 366/262–265, 366/270, 315–317, 330.1, 342, 343; 416/179, 180, 188, 189, 192; 422/227; 415/220

(56) References Cited

U.S. PATENT DOCUMENTS

| | | | | |
|---|---|---|---|---|
| 444,345 | A | * | 1/1891 | Gabbatt |
| 665,580 | A | | 1/1901 | Price |
| 1,281,351 | A | | 10/1918 | Groch |
| 1,283,159 | A | | 10/1918 | Groch |
| 2,190,896 | A | * | 2/1940 | Underwood |
| 2,244,814 | A | * | 6/1941 | Underwood |
| 2,244,815 | A | * | 6/1941 | Underwood |
| 2,254,127 | A | * | 8/1941 | Underwood |
| 2,308,751 | A | * | 1/1943 | Guthrie et al. |
| 2,635,860 | A | * | 4/1953 | McLeod |
| 2,655,436 | A | * | 10/1953 | Bishop et al. |
| 2,658,455 | A | | 11/1953 | Seinfeld |
| 3,233,876 | A | | 2/1966 | Faure et al. |
| 3,479,017 | A | | 11/1969 | Thikotter |
| 3,690,621 | A | * | 9/1972 | Tanaka et al. |
| 4,007,920 | A | * | 2/1977 | Plunguian et al. |
| 4,207,275 | A | | 6/1980 | Stanton, Jr. et al. |
| 4,886,417 | A | | 12/1989 | Remstad et al. |
| 5,215,439 | A | | 6/1993 | Jansen et al. |
| 5,413,460 | A | | 5/1995 | Wilson et al. |
| 5,501,523 | A | | 3/1996 | Weetman et al. ..... 366/263 |
| 5,511,881 | A | | 4/1996 | Post et al. ..... 366/263 |
| 5,584,656 | A | | 12/1996 | Rose |
| 5,605,442 | A | | 2/1997 | Wilson et al. |
| 5,609,468 | A | | 3/1997 | Burgess |
| 5,730,582 | A | | 3/1998 | Heitmann |
| 5,741,123 | A | | 4/1998 | Pauly |
| 5,813,837 | A | | 9/1998 | Yamamoto et al. |
| 2001/0022755 | A1 | * | 9/2001 | Holtzapple et al. |

FOREIGN PATENT DOCUMENTS

| | | | |
|---|---|---|---|
| EP | 153221 | * | 8/1985 |

OTHER PUBLICATIONS

Giralico, M.A., et al., "Improve The Performance of Your Copper Solvent Extraction Process By Optimizing the Design and Operation of Your Pumper and Auxiliary Impellers", *Society For Mining Metallurgy, and Exploration, Inc.*, Preprint No. 95–189, 3/95, pgs. 1–10.

Giralico, M.A., et al., "New Mixer Designs For The Next Generation Of SX/EW Mixer Settler Systems" *Society For Mining, Mettallurgy, And Exploration, Inc.*, Preprint Number 98–120, Mar. 1998, pp. 2–16.

"Article–8 Pages", Date: 1983.

* cited by examiner

*Primary Examiner*—Charles E. Cooley
(74) *Attorney, Agent, or Firm*—Thompson Hine LLP

(57) ABSTRACT

A radial impeller includes a cover having a frusto-conical portion and multiple blades extending radially outwardly. Related mixing systems involve positioning the radial impeller with blades adjacent a flow opening of a tank to draw water through the flow opening when the impeller is rotated.

28 Claims, 5 Drawing Sheets

IN-TANK MIXING SYSTEM AND ASSOCIATED RADIAL IMPELLER

TECHNICAL FIELD

The present invention relates to mixing arrangements for use in tanks, and more particularly to mixing arrangements which utilize radial flow impellers.

BACKGROUND

Radial flow impellers have long been used in continuous flow mixing systems. Such systems have, for example, been used for copper extraction applications and may accomplish their extraction operation by rotating a radial flow impeller near the base of a mixing chamber to expedite the flow of a mineral rich solution into the mixing chamber through a draft opening in the base of the chamber. Such applications are commonly referred to as pumper-mixers or lifter turbines. Exemplary systems using radial flow impellers include those described in U.S. Pat. Nos. 3,233,876, 4,207,275, 5,501,523 and 5,511,881. Other types of mixing systems, including batch systems, utilizing radial flow impellers are also known.

Many prior art radial flow impellers used in such systems consist of a flat plate cap and blades of uniform height positioned generally along the radial direction of the lower surface of the plate. Because the cap is flat and the blades are a uniform height, each blade extends a uniform depth below the cap all along its length from the inner to the outer radius of the cap. While in some applications the blades may trace the radii of the plate exactly, it is also known to use curved blades. Where the blades are of uniform height, and because adjacent blades necessarily are positioned closer to one another at the inner radius of the plate than at the outer radius of the plate, there is an increase in flow area between blades as fluid is pumped from the inner to the outer edge of the radial flow impeller. As a result of this increase in flow area, the flow velocity of fluids that are being pumped decreases near the outer radius of the impeller causing losses in pumping efficiency.

Accordingly, it would be desirable to provide mixing systems incorporating an improved radial flow impeller assembly.

SUMMARY OF THE INVENTION

In one aspect, a continuous flow mixing system for mixing two materials entering an inlet port of a tank, the tank including an outlet positioned above the inlet, is provided. The system includes a drive shaft extending within the tank and aligned with the inlet port. An impeller assembly including a plurality of blades and a cap member is coupled to the drive shaft to be rotated by the drive shaft. The plurality of blades extend radially outwardly, each blade including a lower side, the lower sides being substantially coplanar and lying adjacent the inlet port of the tank, each blade including an upper side. The cap member includes a substantially planar portion and a frusto-conical portion extending radially outward from the substantially planar portion and terminating in a circular rim. Rotation of the impeller assembly produces a head pressure for drawing material in the inlet port and raising a fluid level in the tank to at least a level of the tank outlet. The upper side of each blade is positioned adjacent an inner surface of the cap member and the lower side of each blade is positioned below a plane defied by the circular rim. A radially inner end of each blade is spaced between a central axis of the cap member and an intersection circle defined by intersection of the substantially planar portion and the frusto-conical portion. Each blade extends radially outwardly to at least the circular rim. A radius of the intersection circle is between about thirty percent (30%) and about sixty percent (60%) of a radius of the circular rim. A radial flow area defined by the inner surface of the cap member and adjacent blades of the impeller assembly remains substantially constant from a radial point starting at the intersection circle and extending to the circular rim.

In another aspect, a continuous flow mixing system for mixing two materials entering an inlet port of a tank, the tank including an outlet positioned above the inlet, is provided. The mixing system includes a drive shaft extending within the tank and aligned with the inlet port. An impeller assembly including a plurality of blades and a cap member is coupled to the drive shaft to be rotated by the drive shaft. The plurality of blades extends radially outwardly, each blade including a lower side, the lower sides being substantially coplanar and lying adjacent the inlet port of the tank, each blade including an upper side. The cap member includes a substantially planar portion and a frusto-conical portion extends radially outward from the substantially planar portion and terminates in a circular rim. Rotation of the impeller assembly produces a head pressure for drawing material in the inlet port and raising a fluid level in the tank to at least a level of the tank outlet. The upper side of each blade is positioned adjacent an inner surface of the cap member and the lower side of each blade is positioned below a plane defined by the circular rim. A radial flow area defined by the inner surface of the cap member and adjacent blades of the impeller assembly remains substantially constant from a radial point starting at an intersection circle and extending radially outward therefrom.

In a further aspect, a mixing system for a tank includes a drive shaft extending within the tank and a stationary tube centrally disposed and submerged within the tank, the tube having an upper opening and a lower opening. An impeller assembly including a plurality of blades and a cap member is coupled to the drive shaft to be rotated by the drive shaft. The plurality of blades extend radially outwardly, each blade including an exposed side, the exposed sides being substantially coplanar and lying adjacent the lower opening of the tube, each blade including a covered side. The cap member includes a substantially planar portion and a frusto-conical portion extending radially outward from the substantially planar portion, the frusto-conical portion terminating in a circular rim. Rotation of the impeller assembly draws material in the upper opening of the tube, down through in the tube, out the lower opening of the tube, and back upward along an annular spaced defined between the tube and the tank. The covered side of each blade is positioned adjacent an inner surface of the cap member and the exposed side of each blade is positioned above a plane defied by the circular rim. A radial flow area defined by the inner surface of the cap member and adjacent blades of the impeller assembly remains substantially constant from a radial point starting at an intersection circle defined by intersection of the substantially planar portion and the frusto-conical portion and extending radially outward from the intersection circle.

In another aspect, a mixing system for a tank includes a drive shaft and an impeller assembly. The drive shaft extends within the tank and the impeller assembly is coupled to the drive shaft to be rotated by the drive shaft. The impeller assembly includes a plurality of blades and a cap member. The blades extending radially outwardly, each blade including an exposed side, the exposed sides being substantially coplanar and lying adjacent flow opening of the tank, each blade including a covered side. The cap member includes a substantially planar portion and a frusto-conical portion extending radially outwardly from the substantially planar portion and terminating in a circular rim, rotation of the impeller assembly causing a flow out of the flow opening and through the impeller assembly. The covered side of each blade is positioned adjacent an inner surface of the cap member and the exposed side of each blade is spaced from a plane defined by the circular rim.

In yet another aspect, a mixing system includes an impeller assembly having a plurality of blades and a cap member. The blades extend radially outwardly, each blade including an exposed side, the exposed sides being substantially coplanar, each blade including a covered side. The cap member has an inner surface including a substantially planar portion and a frusto-conical portion extending radially outward from the substantially planar portion and terminating in a circular rim. The covered side of each blade is positioned adjacent the inner surface of the cap member and the exposed side of each blade is spaced away from a plane defied by the circular rim. A radially inner end of each blade is spaced between the central axis of the cap member and an intersection circle defined by intersection of the substantially planar portion and the frusto-conical portion. A radius of the intersection circle is between about thirty percent (30%) and about sixty percent (60%) of a radius of the circular rim. A radial flow area defined by the inner surface of the cap member and adjacent blades of the impeller assembly remains substantially constant from a radial point starting at the intersection circle and extending to the circular rim.

In yet a further aspect, a mixing system includes an impeller assembly having a plurality of blades and a cap member. The blades extend radially outwardly away from a central axis of the assembly, each blade including an exposed side, the exposed sides being substantially coplanar, each blade including a covered side. The cap member has an inner surface including a frusto-conical portion extending radially outward away from the central axis and terminating in a circular rim. The covered side of each blade is positioned adjacent the inner surface of the cap member and the exposed side of each blade is spaced away from a plane defined by the circular rim. A radially inner end of each blade is spaced from the central axis of the cap member and an outer tip of each blade extends at least to the circular rim. A covered blade height is between about sixty-six percent (66%) and about two-hundred thirty-three percent (233%) of an exposed blade height. A plurality of flow channels are defined by the frusto-conical inner surface portion of the cap member, adjacent blades of the impeller assembly and a plane defined by the exposed sides of the blades and the flow area of each flow channel remains substantially constant along its entire radial length.

DETAILED DESCRIPTION

Figure 1:
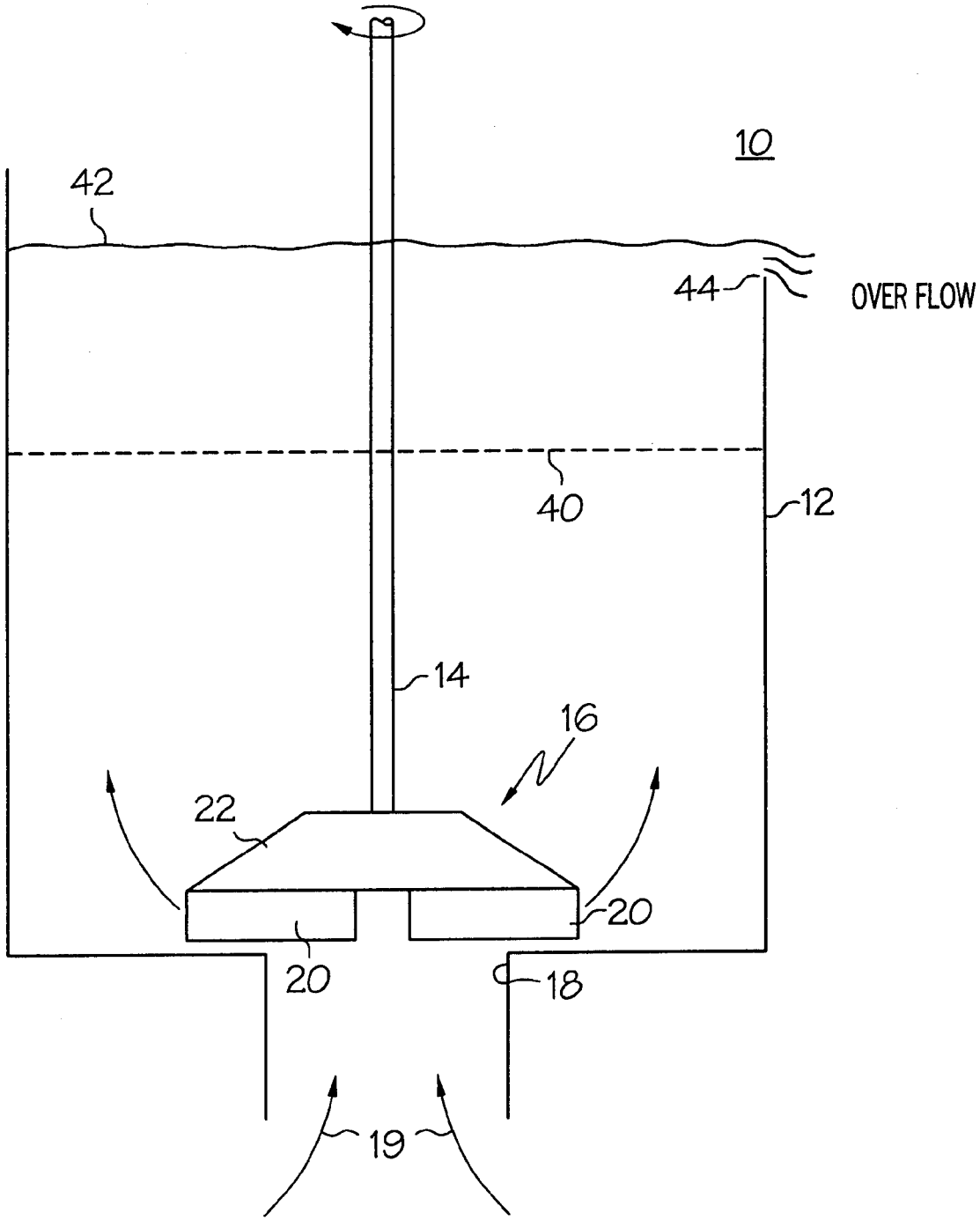
FIG. 1 is a side elevation of one embodiment of a mixing system using a radial flow impeller.

Referring to the drawings, a continuous flow mixing system 10 of a tank 12 is shown. A drive shaft 14 extends within the tank 12 and a radial flow impeller assembly 16 is coupled to the drive shaft for rotation by the drive shaft. The drive shaft 14 may be rotated by any technique commonly known in the art. The impeller assembly 16 is positioned above an inlet port 18 of the tank 12 through which materials may enter the tank as shown by arrows 19. The impeller assembly 16 includes a plurality of blades 20 and a cap member 22. The blades 20 extend radially outward and away from a central axis of rotation of the impeller assembly 16.

Figure 2:
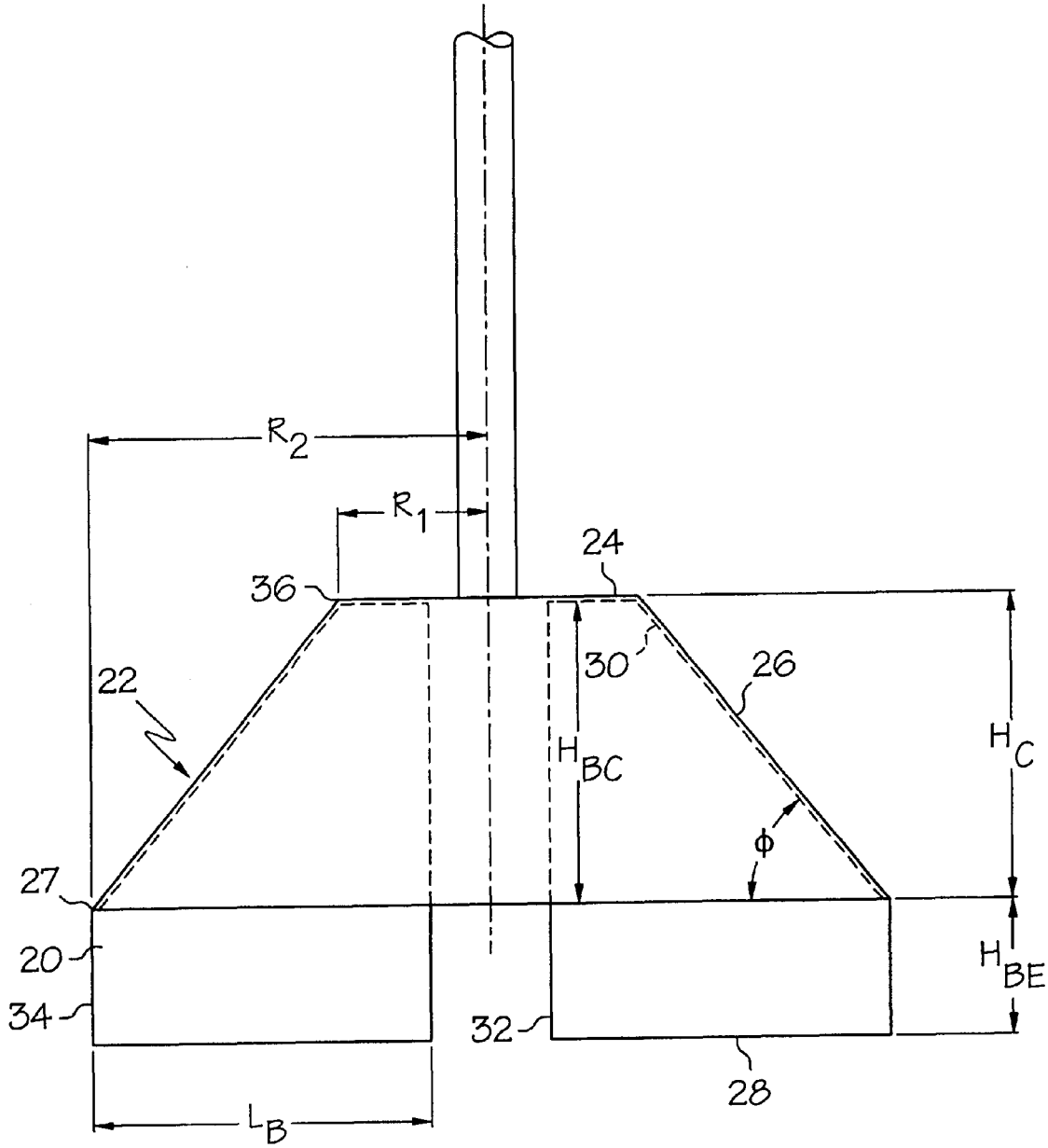
FIG. 2 is an enlarged side elevation of one embodiment of a radial flow impeller.

As best seen in the enlarged impeller assembly view of FIG. 2, the cap member 22 includes a substantially planar portion 24 which is centrally located and a frusto-conical portion 26 which extends radially outward from the substantially planar portion 24 and terminates in a circular rim 27. Each blade 20 includes an exposed side 28, a covered side 30, an inner end 32 and a radially outer end or tip 34. The exposed sides 28 of the blades 20 are substantially coplanar. The covered side 30 of each blade lies adjacent an inner surface of the cap member 22 and may be fixed thereto.

In one arrangement, the frusto-conical portion 26 is angled ($\phi$) such that a radial flow area defined by the inner surface of the cap member 22 and adjacent blades 20 of the impeller assembly 16 remains substantially constant from a radial point starting at an intersection circle 36, defined by intersection of the substantially planar portion 24 and the frusto-conical portion 26, and extending to the circular rim 27. In this respect, the necessary angle ($\phi$) to achieve such a uniform flow area can be calculated as follows. In describing such calculation the term "exposed blade height" is defined as the height ($H_{BE}$) of the blade 20 from its exposed side 28 to the plane defined by the circular rim 27. The term "covered blade height" is defined as the height ($H_{BC}$) of the blade between the plane defined by the circular rim 27 and the substantially planar portion. The covered blade height will typically be substantially equal to the height ($H_C$) of the cap member 22, at least where the outer contour of the cap member follows the inner contour of the cap member. However, it is understood the contour of the outer surface of the cap member 22 could vary from that of the inner surface. To calculate the angle ($\phi$) needed to provide a substantially uniform flow area from the intersection circle 36 to the rim 27, the flow area at the rim ($FA_R$) is first determined as:

$$FA_R=(H_{BE})\times(2\ \pi R_2)$$

$FA_R$ must then be set equal to the flow area at the intersection circle ($FA_I$), where:

$$FA_I=(H_{BE}+H_{BC})\times(2\ \pi R_1).$$

If initial impeller assembly design parameters are set as $H_{BE}$=to 0.4 $R_2$, and $R_1$=0.5 $R_2$, then:

$$FA_R=FA_I$$

$$(H_{BE})\times(2\ \pi R_2)=(H_{BE}+H_{BC})\times(2\ \pi R_1)$$

$$(0.4\ R_2)\times(2\ \pi R_2)=(0.4\ R_2+H_{BC})\times(2\ \pi(0.5\ R_2))$$

$$0.8\ R_2^2=0.4\ R_2^2+R_2H_{BC}$$

$$0.4\ R_2^2=R_2H_{BC}$$

$$0.4\ R_2=H_{BC}$$

The angle ($\phi$) follows as:

$$\phi=\tan^{-1}[H_{BC}/(R_2-R_1)]$$

$$\phi=\tan^{-1}[0.4\ R_2/(R_2-0.5\ R_2)]$$

$$\phi=\tan^{-1}[0.4\ R_2/(0.5\ R_2)]=\tan^{-1}[0.8]$$

$$\phi=38.7°$$

Thus, by setting design criteria including the exposed blade height ($H_{BE}$) and the radius of the intersection circle ($R_1$), the necessary angle ($\phi$) can be determined. In one arrangement $R_1$ is selected between about thirty percent (30%) and about sixty percent (60%) of the radius ($R_2$) of the circular rim 27. In another arrangement $R_1$ is selected between about forty percent (40%) and about fifty percent (50%) of the radius ($R_2$) of the circular rim 27. Where flow area is equalized, the $R_1$=(30–60%)$R_2$ design parameter will generally result in a covered blade height ($H_{BC}$) between about two-hundred thirty-three percent (233%) and about sixty-six percent (66%) of the exposed blade height ($H_{BE}$). The $R_1$=(40–50%)$R_2$ design parameter will generally result in a covered blade height ($H_{BC}$) between about one-hundred fifty percent (150%) and one-hundred percent (100%) of the exposed blade height ($H_{BE}$).

Figure 3A:
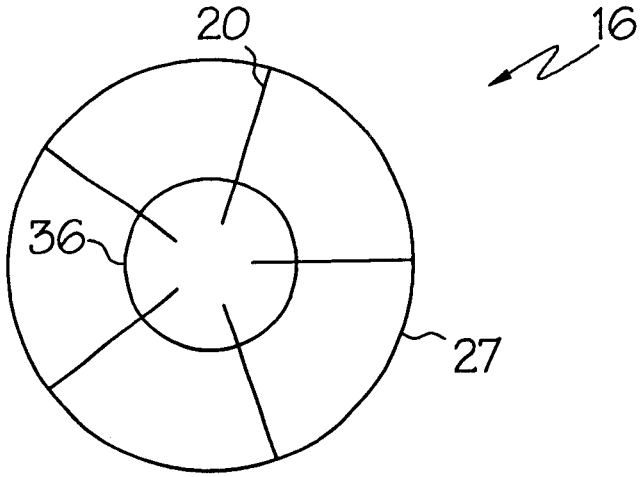
FIGS. 3A and 3B are bottom views of radial flow impeller arrangements.
Figure 3B:
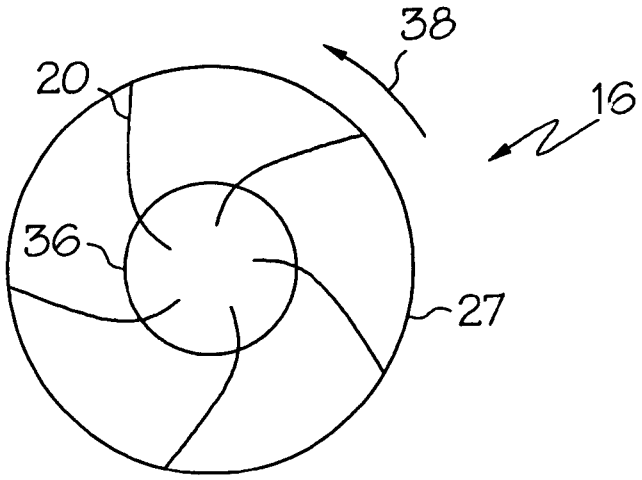

Referring to the impeller assembly bottom views of FIGS. 3A and 3B, the blades 20 may be straight in one embodiment (FIG. 3A) or may curve in a direction away from the direction of rotation 38 of the impeller assembly in another embodiment (FIG. 3B). Five blades 20 are shown in each embodiment, but it is recognized that the number of blades could vary according to the application. Additionally, while uniformly spaced blades are shown, in some circumstances the spacing could very, particularly where pairs of blades are positioned in close proximity to each other and are spaced from other pairs of blades.

Referring again to FIG. 1, the exposed sides 28 of the blades 20 are positioned at the lower end of the impeller assembly 16 and adjacent the inlet port 18 of the tank 12. In one arrangement the spacing between the exposed sides of the blades and the tank wall defining the inlet port is maintained at less than ten percent of the impeller assembly diameter, and in another arrangement at less than five percent of the impeller assembly diameter. When the impeller assembly 16 is rotated a head pressure is created which causes liquid to flow into the tank 12 through port 18 and also causes the normal liquid level 40 of the tank 12 to rise to a level 42 which causes liquid to flow out of an overflow or other outlet 44 of the tank 12, thus resulting in a flow through the tank 12.

Figure 4:
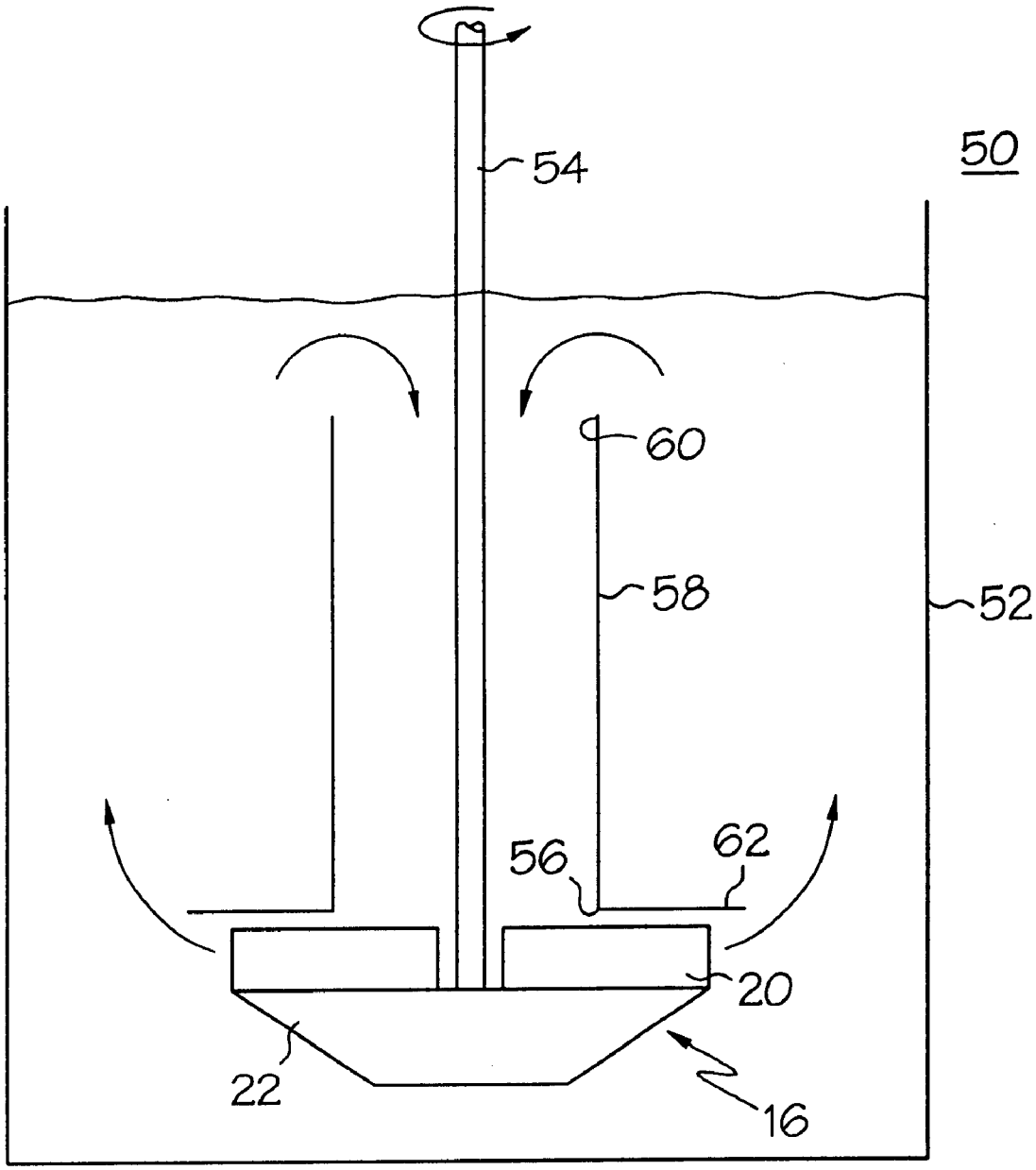
FIG. 4 is a side elevation of another mixing system embodiment.
Figure 5:
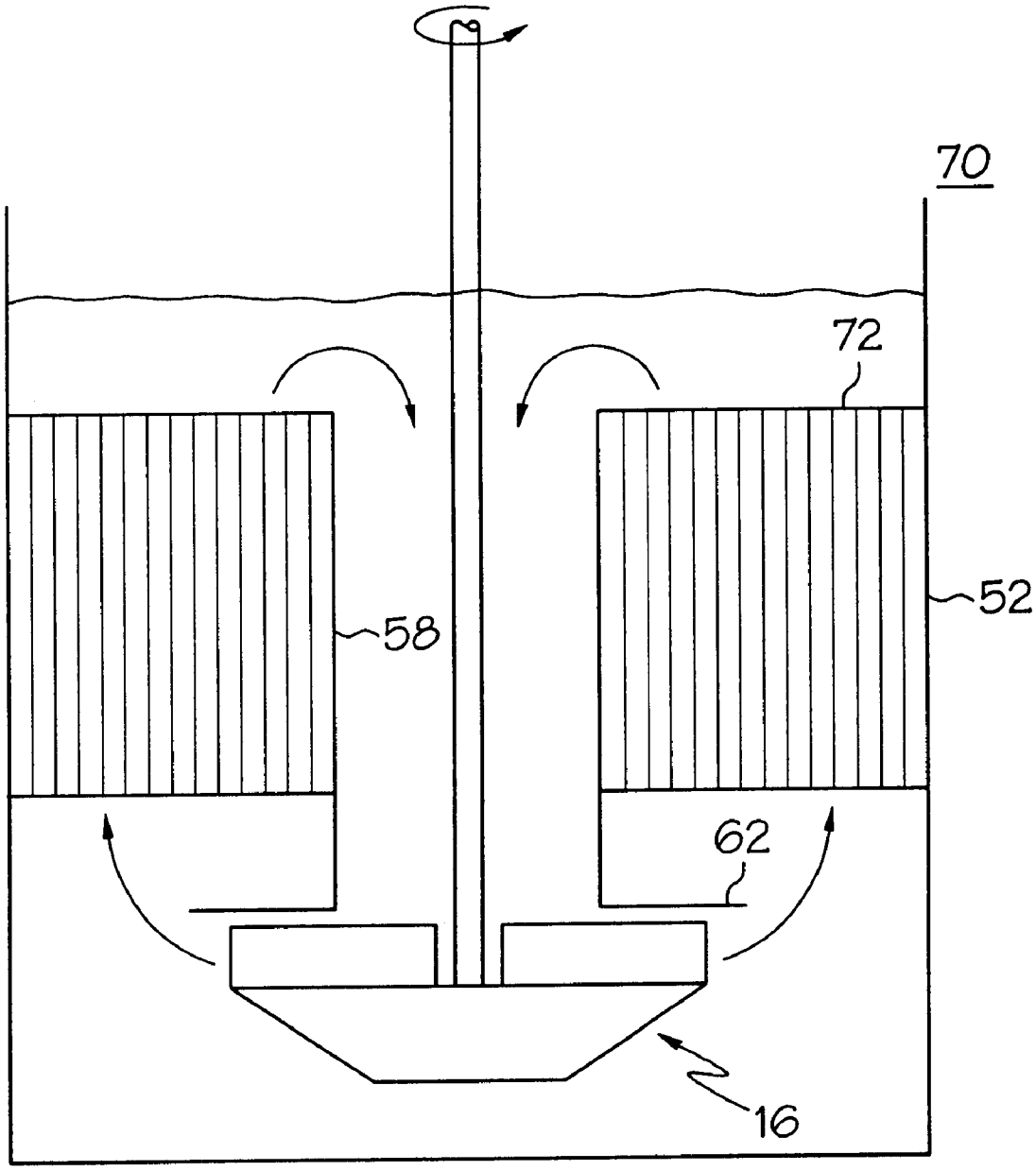
FIG. 5 is a side elevation of another mixing system embodiment.

An alternative mixing system arrangement 50 is shown in FIG. 4 where a tank 52 includes a drive shaft 54 extending therein. The impeller assembly 16 is coupled to the drive shaft 54 for rotation, but is arranged in an upside-down position in comparison to that of FIG. 1. The exposed sides of the blades 20 are positioned adjacent a lower opening 56 of a stationary draft tube 58 which is centrally disposed and submerged within the tank 52. Rotation of the impeller assembly 16 causes liquid to be drawn in an upper opening 60 of the draft tube 58, down through the draft tube 58, out the lower opening 56 and back upward along the annular space defined between the tube 58 and the tank 52. The draft tube 58 may include an annular plate 62 extending outward from the opening 56, preferably to a radius which is at least as great as a radius of the impeller assembly 16. In another embodiment shown in FIG. 5, the mixing system 70 includes a calandria or stationary tube bundle 72 in the annular space between the tube 58 and the tank 52, which is commonly used for removing heat from the system.

Although the invention has been described above in detail referencing the preferred embodiments thereof, it is recognized that various changes and modifications could be made without departing from the spirit and scope of the invention.

What is claimed is:

1. A continuous flow mixing system for mixing two materials, the system comprising:

a tank including an outlet positioned above an inlet port;

a drive shaft extending within the tank and aligned with the inlet port;

an impeller assembly coupled to the drive shaft to be rotated by the drive shaft, the impeller assembly including a plurality of blades extending radially outwardly, each blade including a lower side, the lower sides being substantially coplanar and lying adjacent the inlet port of the tank, each blade including an upper side, a cap member including a substantially planar portion and a frusto-conical portion extending radially outwardly from the substantially planar portion and terminating in a circular rim, rotation of the impeller assembly producing a head pressure for drawing material in the inlet port and raising a fluid level in the tank to at least a level of the tank outlet;

wherein the upper side of each blade is positioned adjacent an inner surface of the cap member and the lower side of each blade is positioned below a plane defined by the circular rim, wherein a radially inner end of each blade is spaced between a central axis of the cap member and an intersection circle defined by intersection of the substantially planar portion and the frusto-conical portion, wherein each blade extends radially outward to at least the circular rim, wherein a radius of the intersection circle is between about thirty percent (30%) and about sixty percent (60%) of a radius of the circular rim, and wherein a radial flow area defined by the inner surface of the cap member and adjacent blades of the impeller assembly remains substantially constant from a radial point starting at the intersection circle and extending to the circular rim.

2. A continuous flow mixing system for mixing two materials, the system comprising:

a tank including an outlet positioned above an inlet port;

a drive shaft extending within the tank and aligned with the inlet port;

an impeller assembly coupled to the drive shaft to be rotated by the drive shaft, the impeller assembly including a plurality of blades extending radially outwardly, each blade including a lower side, the lower sides being substantially coplanar and lying adjacent the inlet port of the tank, each blade including an upper side, a cap member including a substantially planar portion and a frusto-conical portion extending radially outwardly from the substantially planar portion and terminating in a circular rim, rotation of the impeller assembly producing a head pressure for drawing material in the inlet port and raising a fluid level in the tank to at least a level or the tank outlet;

wherein the upper side of each blade is positioned adjacent an inner surface of the cap member and the lower side of each blade is positioned below a plane defined by the circular rim, and wherein a radial flow area defined by the inner surface of the cap member and adjacent blades of the impeller assembly remains substantially constant from a radial point starting at an intersection circle defined by intersection of the substantially planar portion and the frusto-conical portion and extending radially outward therefrom.

3. The mixing system of claim 2 wherein each blade of the impeller assembly is substantially straight.

4. The mixing system of claim 2 wherein each blade of the impeller assembly curves from its radially inner end to its tip in a direction away from a direction of rotation of the impeller assembly.

5. The mixing system of claim 2 wherein a radius of the intersection circle is between about thirty percent (30%) and about sixty percent (60%) of a radius of the circular rim.

6. The mixing system of claim 5 wherein the radius of the intersection circle is between about forty percent (40%) and about fifty percent (50%) of the radius of the circular rim.

7. The mixing system of claim 2 wherein a covered blade height is between about sixty-six percent (66%) and about two-hundred thirty-three percent (233%) of an exposed blade height.

8. A mixing system comprising:

a tank;

a drive shaft extending within the tank;

a stationary tube centrally disposed and submerged within the tank, the tube having an upper opening and a lower opening;

an impeller assembly coupled to the drive shaft to be rotated by the drive shaft, the impeller assembly including a plurality of blades extending radially outwardly, each blade including an exposed side, the exposed sides being substantially coplanar and lying adjacent the lower opening of the tube, each blade including a covered side, a cap member including a substantially planar portion and a frusto-conical portion extending radially outward from the substantially planar portion, the frusto-conical portion terminating in a circular rim, rotation of the impeller assembly producing a head pressure for drawing material in the upper opening of the tube, down through the tube, out the lower opening of the tube, and back upward along an annular spaced defined between the tube and the tank;

wherein the covered side of each blade is positioned adjacent an inner surface of the cap member and the exposed side of each blade is positioned above a plane defined by the circular rim, and wherein a radial flow area defined by the inner surface of the cap member and adjacent blades of the impeller assembly remains substantially constant from a radial point starting at an intersection circle defined by intersection of the substantially planar portion and the frusto-conical portion and extending radially outward from the intersection circle.

9. The mixing system of claim 8 wherein each blade of the impeller assembly is substantially straight.

10. The mixing system of claim 8 wherein each blade of the impeller assembly curves from its radially inner end to its tip in a direction away from a direction of rotation of the impeller assembly.

11. The mixing system of claim 8 wherein a radius of the intersection circle is between about thirty percent (30%) and about sixty percent (60%) of a radius of the circular rim.

12. The mixing system of claim 11 wherein the radius of the intersection circle is between about forty percent (40%) and about fifty percent (50%) of the radius of the circular rim.

13. The mixing system of claim 8 wherein a covered blade height is between about sixty-six percent (66%) and about two-hundred thirty-three percent (233%) of an exposed blade height.

14. The mixing system of claim 8 wherein a plurality of stationary tube bundles are positioned in the annular space defined between the tube and the tank for facilitating heat transfer from fluid in the tank.

15. The mixing system of claim 14 wherein the lower opening of the tube is surrounded by an annular plate having an outer radius which is at least as great as a radius of the impeller assembly.

16. The mixing system of claim 8 wherein the lower opening of the tube is surrounded by an annular plate having an outer radius which is at least as great as a radius of the impeller assembly.

17. A mixing system comprising:

a tank having a flow opening;

a drive shaft extending within the tank;

an impeller assembly coupled to the drive shaft to be rotated by the drive shaft the impeller assembly including a plurality of blades extending radially outwardly, each blade including an exposed side, the exposed sides being substantially coplanar and lying adjacent the flow opening of the tank, each blade including a covered side, a cap member including a substantially planar portion and a frusto-conical portion extending radially outwardly from the substantially planar portion and terminating in a circular rim, rotation of the impeller assembly causing a flow out of the flow opening and through the impeller assembly;

wherein the covered side of each blade is positioned adjacent an inner surface of the cap member and the exposed side of each blade is spaced from a plane defined by the circular rim.

18. The mixing system of claim 17 wherein a radial flow area defined by the inner surface of the cap member and adjacent blades of the impeller assembly remains substantially constant from a radial point starting at an intersection circle defined by intersection of the substantially planar portion and the frusto-conical portion and extending radially outward therefrom.

19. The mixing system of claim 18 wherein a radius of the intersection circle is between about thirty percent (30%) and about sixty percent (60%) of a radius of the circular rim.

20. The mixing system of claim 19 wherein the radius of the intersection circle is between about forty percent (40%) and about fifty percent (50%) of the radius of the circular rim.

21. The mixing system of claim 17 wherein a covered blade height is between about sixty-six percent (66%) and about two-hundred thirty-three percent (233%) of an exposed blade height.

22. A mixing system comprising:

an impeller assembly having a plurality of blades extending radially outwardly, each blade including an exposed side, the exposed sides being substantially coplanar, each blade including a covered side, a cap member having an inner surface including a substantially planar portion and a frusto-conical portion extending radially outward from the substantially planar portion and terminating in a circular rim, wherein the covered side of each blade is positioned adjacent the inner surface of the cap member and the exposed side of each blade is spaced away from a plane defined by the circular rim, wherein a radially inner end of each blade is spaced between the central axis of the cap member and an intersection circle defined by intersection of the substantially planar portion and the frusto-conical portion, wherein a radius of the intersection circle is between about thirty percent (30%) and about sixty percent (60%) of a radius of the circular rim, and wherein a radial flow area defined by the inner surface of the cap member and adjacent blades of the impeller assembly remains substantially constant from a radial point starting at the intersection circle and extending to the circular rim.

23. The mixing system of claim 22 wherein the radius of the intersection circle is between about forty percent (40%) and about fifty percent (50%) of a radius of the circular rim.

24. The mixing system of claim 22, further comprising a flow opening, the impeller assembly positioned with the exposed side of each blade adjacent the flow opening for drawing liquid through the flow opening when the impeller assembly is rotated.

25. A mixing system comprising:

an impeller assembly having a plurality of blades extending radially outwardly away from a central axis of the assembly, each blade including an exposed side, the exposed sides being substantially coplanar, each blade including a covered side, a closed cap member having an inner surface including a frusto-conical portion extending radially outward away from the central axis and terminating in a rim, wherein the covered side of each blade is positioned adjacent the inner surface of the cap member and the exposed side of each blade is spaced away from the rim so as to be uncovered and spaced from the closed cap member, wherein a radially inner end of each blade is spaced from the central axis, and wherein a plurality of flow channels are defined by the frusto-conical inner surface portion of the cap member, adjacent blades of the impeller assembly and a plane defined by the exposed sides of the blades, wherein the flow area of each flow channel remains substantially constant along its radial length.

26. The mixing system of claim 25 wherein the rim is circular and defines a plane, an outer tip of each blade extends to at least the circular rim, and wherein a covered blade height is between about sixty-six percent (66%) and about two-hundred thirty-three percent (233%) of an exposed blade height.

27. The mixing system of claim 25, further comprising a flow opening, the impeller assembly positioned with the exposed side of each blade adjacent the flow opening for drawing liquid through the flow opening when the impeller assembly is rotated.

28. The mixing system of claim 25 wherein the inner surface of the closed cap member includes a substantially planar portion, a radially inner end of each blade is spaced between the central axis and an intersection circle defined by intersection of the substantially planar portion and the frusto-conical portion.

* * * * *